US008228191B2

(12) United States Patent
Woods

(10) Patent No.: US 8,228,191 B2
(45) Date of Patent: Jul. 24, 2012

(54) ANTI-TAMPER ASSEMBLY FOR SURFACE MOUNTED SECURITY SWITCH

(75) Inventor: Randall Woods, Sun Lakes, AZ (US)

(73) Assignee: Magnasphere Corp., Waukesha, WI (US)

( * ) Notice: Subject to any disclaimer, the term of this patent is extended or adjusted under 35 U.S.C. 154(b) by 763 days.

(21) Appl. No.: 12/414,481

(22) Filed: Mar. 30, 2009

(65) Prior Publication Data

US 2010/0245089 A1 Sep. 30, 2010

(51) Int. Cl.
*G08B 13/14* (2006.01)

(52) U.S. Cl. ..... 340/568.1; 340/539.31

(58) Field of Classification Search ..... 340/568.1, 340/539.31, 572.9; 355/205
See application file for complete search history.

(56) References Cited

U.S. PATENT DOCUMENTS

| | | | | |
|---|---|---|---|---|
| 5,332,992 | A | 7/1994 | Woods | |
| 5,530,428 | A | 6/1996 | Woods | |
| 5,668,533 | A | 9/1997 | Jackson, Jr. et al. | |
| 5,673,021 | A | 9/1997 | Woods | |
| 5,877,664 | A | 3/1999 | Jackson, Jr. | |
| 5,889,659 | A | 3/1999 | Emmerich | |
| 5,977,873 | A | 11/1999 | Woods | |
| 6,087,936 | A | 7/2000 | Woods | |
| 6,506,987 | B1 | 1/2003 | Woods | |
| 6,603,378 | B1 | 8/2003 | Collins | |
| 6,609,738 | B1 * | 8/2003 | Roth et al. | 292/251.5 |
| 6,803,845 | B2 | 10/2004 | Woods | |
| 7,023,308 | B2 | 4/2006 | Woods | |
| 7,248,136 | B2 | 7/2007 | Habboosh | |
| 7,291,794 | B2 | 11/2007 | Woods | |
| 2007/0152784 | A1 * | 7/2007 | Habboosh | 335/205 |
| 2008/0128453 | A1 * | 6/2008 | Burckholter et al. | 222/75 |

* cited by examiner

*Primary Examiner* — Shirley Lu
(74) *Attorney, Agent, or Firm* — Hovey Williams LLP

(57) ABSTRACT

An anti-tamper assembly (40, 40*a*) is provided in order to sense the attempted removal of a body attached to a surface (17) by a fastener (36, 36*a*). The assembly (40, 40*a*) includes an anti-tamper access-blocking element (42, 42*a*) positioned in an anti-tamper position proximal to the fastener (36, 36*a*), along with an anti-tamper switch (44, 102) operably coupled with the element (42, 42*a*) in order to bias the switch (44, 102) to one switch condition. In the event that the element (42, 42*a*) is moved from its anti-tamper position, the switch (44, 102) moves to another switch condition, which generates an alarm signal. The assembly (40, 40*a*) may be used to protect an alarm section (16, 16*a*) forming a part of an alarm assembly (10, 10*a*). The section (16, 16*a*) includes a sensor or switch (64) operable to detect relative movement between first and second members such as a door (12) and doorframe (14). In one embodiment, a magnetically actuatable switch (42) is employed with a mating access-blocking element (42) in the form of a magnet. Alternately, a mechanically actuatable switch (102) having an actuating arm (104) may be used where the arm (104) engages access-blocking element (42*a*).

7 Claims, 4 Drawing Sheets

ANTI-TAMPER ASSEMBLY FOR SURFACE MOUNTED SECURITY SWITCH

BACKGROUND OF THE INVENTION

1. Field of the Invention

The present invention is broadly concerned with anti-tamper assemblies for use in preventing removal of bodies mounted on surfaces through use of a fastener. More particularly, the invention is concerned with such anti-tamper assemblies which may be used in conjunction with proximity or movement-sensing switches and include an access-blocking element such as a plug or magnetic component (e.g., a magnet) located in an anti-tamper position relative to the fastener, together with an anti-tamper switch which is operably coupled with the access-blocking element for actuation of the anti-tamper switch upon movement of the access-blocking element from the anti-tamper position thereof.

2. Description of the Prior Art

Security alarm systems often make use of magnetically actuatable switches attached to doors and windows for detecting unauthorized openings. One type of switch utilized in this context is a reed switch. However, reed switches are subject to unauthorized manipulation through use of an external magnet. Specifically, a compact high-energy magnet may be positioned in proximity to the reed switch, which will then be operated to either open or close the switch depending upon the control scheme. Once this is accomplished, an intruder may open the door or window without triggering the alarm system.

In response to these problems, the Magnasphere Corporation of Waukesha, Wis. has introduced improved switches not subject to external magnetic manipulation. These switches typically include a pair of spaced-apart switch elements with a shiftable body (e.g., a spherical ball) moveable between respective positions corresponding to different switch conditions. Thus, the ball may be in simultaneous contact with the switch elements in one condition, and out of such simultaneous contact in another condition. An alarm circuit is electrically coupled to the switch elements in order to generate an alarm signal upon a change in switch condition. The Magnasphere switches are described in U.S. Pat. Nos. 5,332,992; 5,530,428; 5,673,021; 5,889,659; 5,977,873; 6,087,936; 6,506,987; 6,603,378; 6,803,845; 7,023,308; 7,248,136; and 7,291,794. Other magnetic switches are described in U.S. Pat. Nos. 5,668,533 and 5,877,664.

In many instances it is necessary to mount alarm system components on the surfaces of doors or windows to be protected using fasteners such as screws, rather than having these components embedded within the protected structures. Such surface-mounted alarm systems can be vulnerable because the one or more of the switch components may be detached by the simple expedient of removing the fasteners. Accordingly, in order to protect the integrity of surface-mounted alarm systems or more broadly any surface-mounted body, an anti-tamper alarm assembly is required.

SUMMARY OF THE INVENTION

The present invention overcomes the problems outlined above and provides a simplified anti-tamper assembly operable to sense the attempted removal of a body attached to a surface by a fastener (e.g., a screw extending through the body and adjacent mounting surface). Broadly speaking, an anti-tamper assembly in accordance with the invention includes an access-blocking element positioned in an anti-temper position proximal to the fastener, and a mating anti-tamper switch operably (e.g., magnetically or mechanically) coupled with the access-blocking element so that movement of the latter causes the anti-tamper switch to operate.

In one preferred embodiment the access-blocking element is a magnetic component and the anti-tamper switch is a magnetically actuatable with a shiftable, magnetically responsive component as a part thereof. As used herein, a "magnetically actuatable switch" refers to a switch which is shiftable between first and second different switch positions in response to different magnetic conditions in the region of the switch. The access-blocking element may itself be a magnet while the shiftable component of the mating switch component is responsive to ambient magnetic conditions; alternately, the shiftable switch component may be a magnet while the access-blocking element may be formed of steel or other material attracted to the switch component magnet. In either case, the access-blocking magnetic component interacts with the magnetically responsive anti-tamper switch so that the latter assumes a first switch condition when the access-blocking magnetic component is in the anti-tamper position thereof. The anti-tamper switch is operable to assume a different, second switch condition when the access-blocking magnetic component is moved from the anti-tamper position to a tamper position, permitting access to the fastener for removal thereof. Advantageously, the anti-tamper assembly also has an alarm circuit coupled with the anti-tamper switch and operable to generate an alarm signal in response to the movement of the anti-tamper magnetic component to the tamper position.

In preferred forms, the anti-tamper switch is a Magnasphere switch coupled with an anit-tamper magnet. The switch comprises a housing, a pair of spaced-apart switch elements, and a shiftable, electrically conductive, metallic body within the housing and moveable between respective first and second switch conditions under the influence of ambient magnetic conditions. A first magnetic component such as a magnet is associated with the switch housing and serves to bias the shiftable body to one of the switch conditions. However such bias is overcome by the presence of the anti-tamper magnet which moves the shiftable body to the other switch condition. Upon removal of the anti-tamper magnet, the switch housing magnet serves to move the shiftable body to the one switch condition. Normally, one of the switch conditions corresponds to the moveable body being in simultaneous contact with both switch elements, while the other switch conditions correspond to the body being out of simultaneous contact with the switch elements. Depending upon the selected switch control scheme, the alarm circuit may be triggered when the switch is in either of these conditions.

In another preferred embodiment, the anti-tamper switch may be a mechanical switch such as a micro-switch, and the access-blocking element may be a plug or block formed of any convenient material. In such a case, the actuating switch has an arm which engages the access-blocking element in order to maintain the switch in a first condition. If the access-blocking element is removed from the anti-tamper position thereof, the switch arm shifts in order to change the condition of the switch, which in turn activates the alarm circuit.

One important use for the anti-tamper assemblies of the invention is in the protection of movement or proximity sensors or switches mounted on the surface of a first member and operable to detect movement of a second member from a position in close proximity to the first member to a position remote from the first member. For example, the sensors or switches may be mounted on a window or doorframe, in order to detect opening of the associated door or window. The movement or proximity sensor is also preferably a Magnasphere switch of the type described above, including a housing magnet serving to bias the electrically conductive and moveable body to one of the switch conditions. The second member has a magnet oriented such that, when the second member is adjacent the first member, the second member magnet overcomes the bias of the housing magnet and shifts the moveable body to the other of the switch conditions.

DETAILED DESCRIPTION OF THE PREFERRED EMBODIMENT

Embodiment of FIGS. 1-7 Using Magnetically Actuated Anti-Tamper Switch

Figure 1:
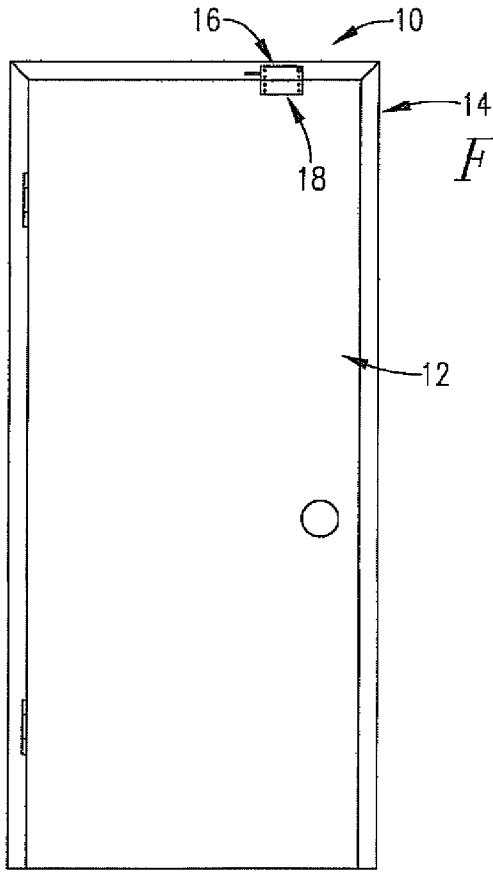
FIG. 1 is an elevational view of a door protected by a magnetically actuated surface-mounted alarm assembly in accordance with the invention.

Turning now to FIG. 1, an anti-tamper alarm assembly 10 is illustrated in operative position for protecting a door 12 mounted in a doorframe 14. The alarm assembly 10 broadly includes an alarm section 16 mounted on the outer surface 17 of doorframe 14, as well as a magnetic section 18 mounted on the adjacent outer surface 19 of door 12. Broadly, the assembly 10 is designed to trigger an alarm upon unauthorized opening of door 12. Moreover, the assembly 10 is provided with specialized anti-tamper structure which likewise triggers an alarm in the event that an intruder attempts to remove the alarm section 16 from doorframe 14.

Figure 2:
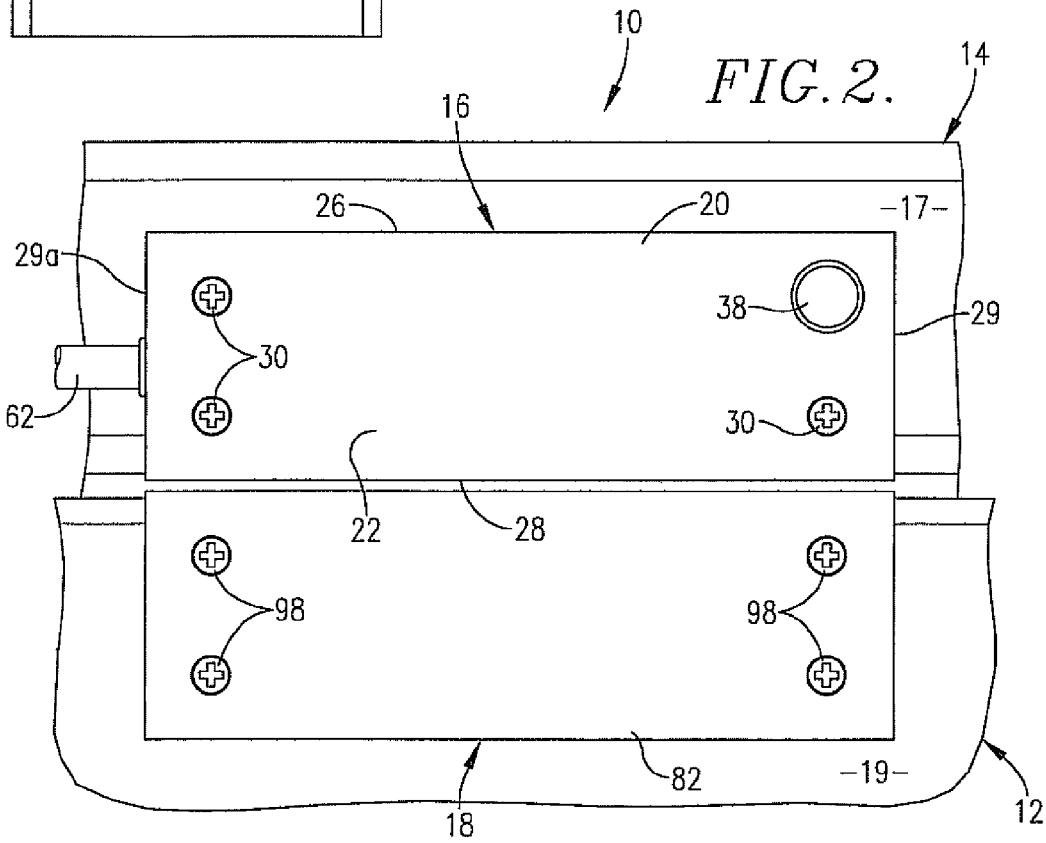
FIG. 2 is an enlarged, fragmentary view illustrating the sections of the surface-mounted alarm assembly of FIG. 1.
Figure 5:
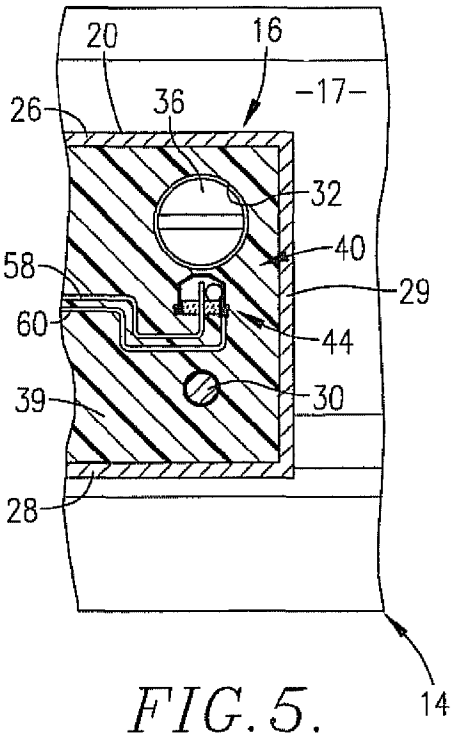
FIG. 5 is a fragmentary, sectional view of the anti-tamper switch of the surface-mounted alarm assembly of FIGS. 1 and 2, shown in an actuated condition upon attempted removal of the alarm section thereof.
Figure 4:
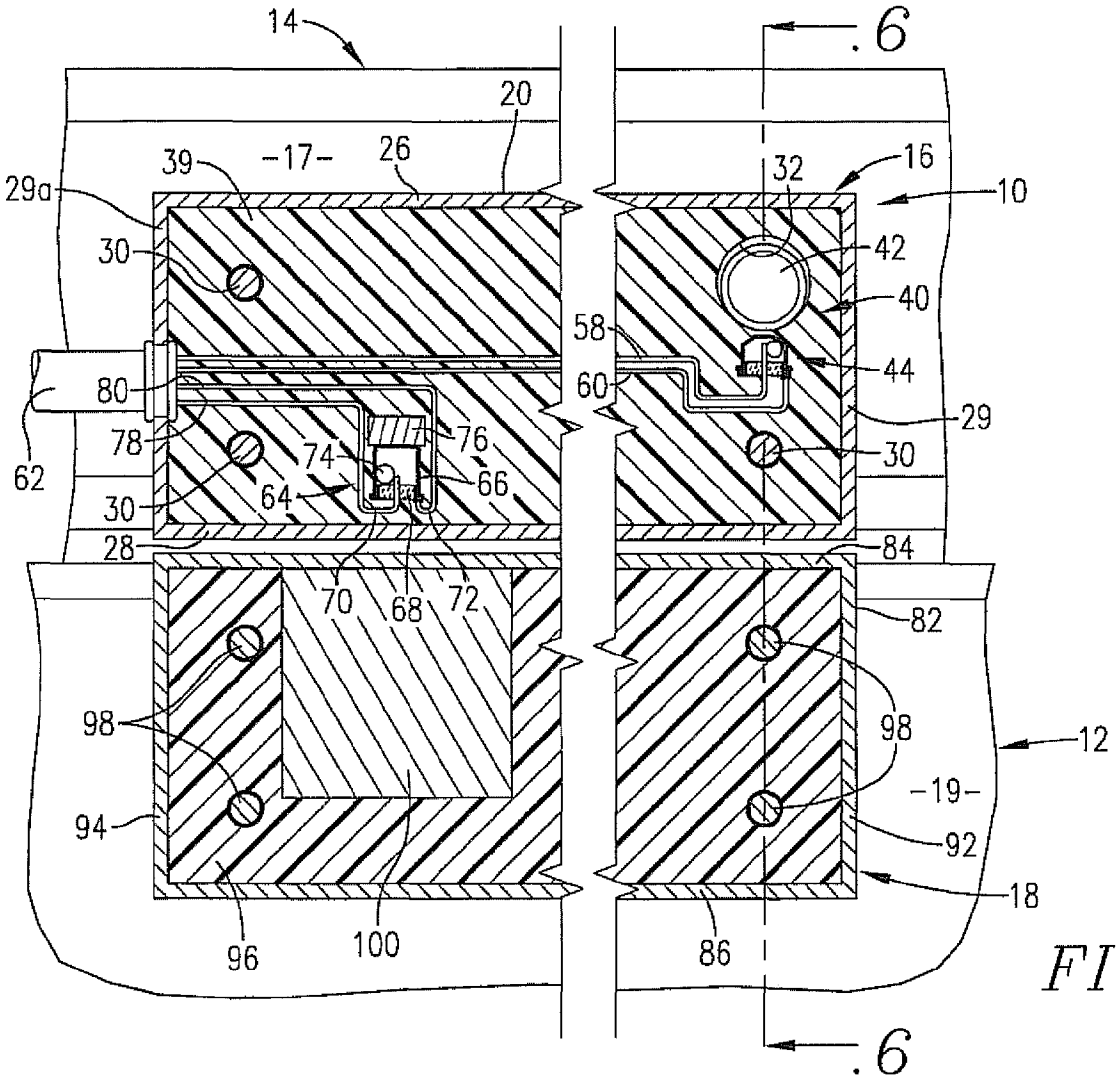
FIG. 4 is a vertical sectional view of the sections of the surface-mounted alarm assembly of FIGS. 1 and 2.
Figure 7:
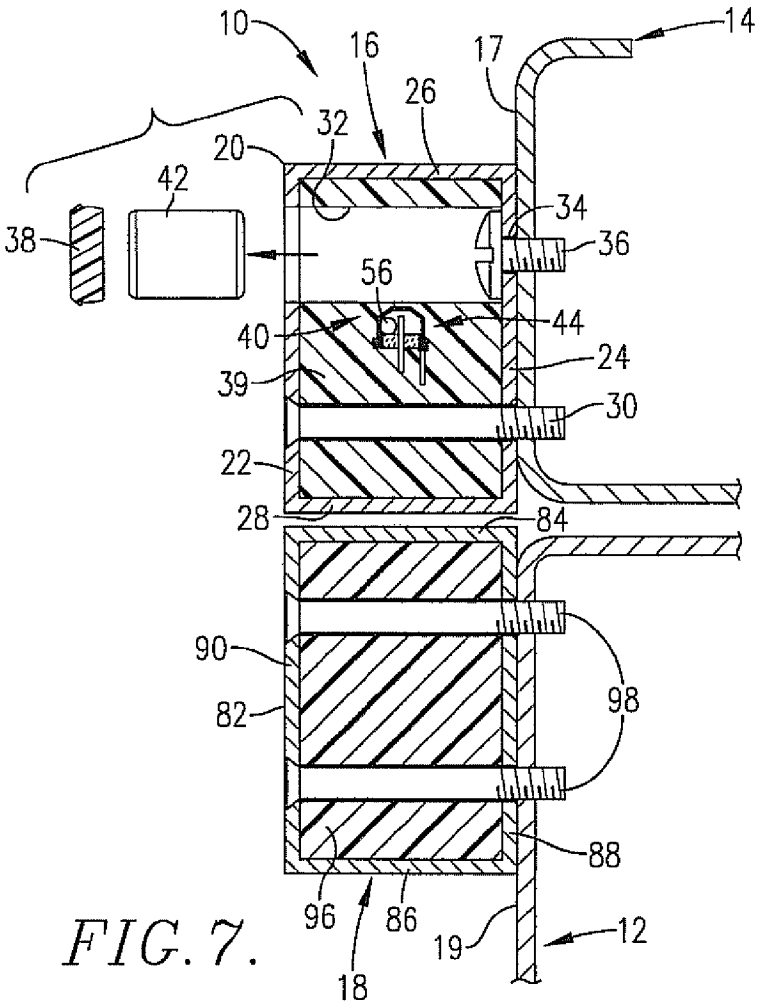
FIG. 7 is a vertical sectional view similar to that of FIG. 6, but showing the parts of the anti-tamper assembly of FIGS. 1 and 2 in exploded relation.
Figure 6:
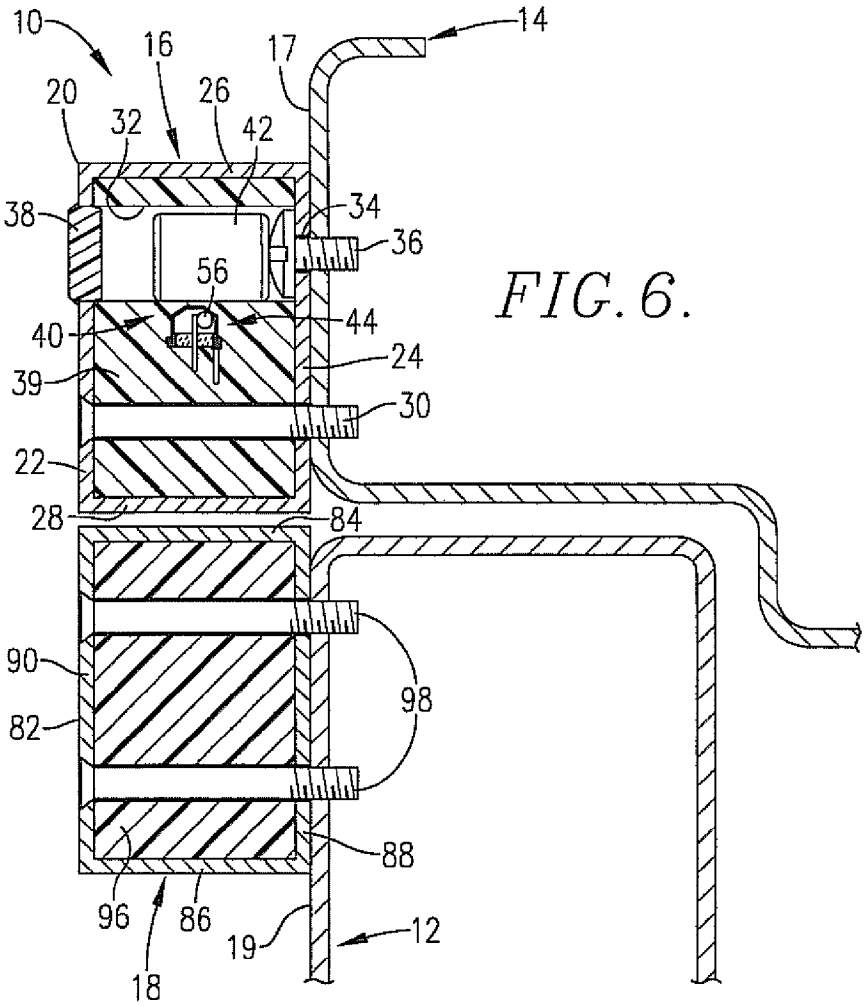
FIG. 6 is a vertical sectional view taken along lines 6-6 of FIG. 4.

In more detail, the alarm section 16 includes a box-like housing 20 having an outer wall 22, inner wall 24, top and bottom walls 26, 28, and end walls 29, 29*a*. The inner wall 24 abuts surface 17 as shown. A total of three long screws 30 extend through suitable openings provided in the walls 22, 24 and through the outer surface 17 of doorframe 14 and into the interior of the latter. Additionally, the housing 20 has a larger passageway 32 extending through outer wall 22 and which is aligned with a smaller, screw-receiving opening 34 provided through inner wall 24. A short screw 36 extends through the opening 34, and passes through surface 17 and into the interior of doorframe 14. A removable plug 38 is situated within passageway 32 as shown in FIGS. 2, 4, and 6. The interior of section 16 has a synthetic fill 39 which fills the entirety of the section save for the operative and connective components therein, and the passageway 32.

The section 16 further includes an anti-tamper assembly 40 designed to initiate an alarm in the event that an intruder attempts to remove the alarm section 16 from doorframe 14 by removal of screws 30 and 36. Generally, the assembly 40 comprises an anti-tamper access-blocking element 42 in the form of a cylindrical magnet positioned in proximity to the head of screw 36 beneath plug 38, and a magnetically actuatable anti-tamper switch 44 operably coupled with the element 42.

Figure 3:
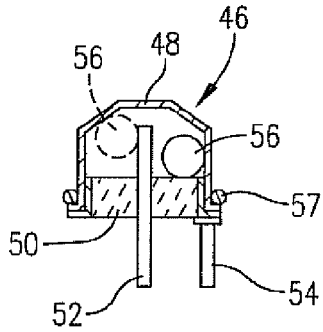
FIG. 3 is a sectional view of the preferred magnetically actuatable anti-tamper switch forming a part of the surface-mounted alarm assembly of FIGS. 1 and 2.

In preferred forms, the anti-tamper switch 44 is a Magnasphere switch 46 of the type illustrated in FIG. 3. Such a switch includes a conductive housing 48 with a dielectric plug 50 closing the open end of the housing. A pair of first and second switch elements or electrodes 52 and 54 form a part of switch 46, with the element 52 passing centrally through plug 50, whereas element 54 is operably connected with conductive housing 48. The switch 46 also includes a shiftable, electrically conductive ball 56 within housing 48 and moveable therein under the influence ambient magnetic conditions between respective switch conditions; one switch condition illustrated in phantom in FIG. 3 is when the ball 56 is in simultaneous electrical contact with the housing 48 (and thus switch element 54) and central switch element 52, whereas the other switch condition illustrated in full lines in FIG. 3 is when the ball 56 is out of such simultaneous contact. The ball 56 is preferably formed of a magnetic metallic material. A magnetic biasing ring 57 is located about housing 48 as shown and serves to magnetically bias the ball 56 to the full line position thereof in the absence of a stronger or opposing magnetic field. Of course, other types of magnetically actuatable switches could be employed such as reed switches or switches of the type described in U.S. Pat. Nos. 5,877,664 and 5,668,533. However, the ensuing description will describe the use of a Magnasphere switch 46 as the anti-tamper switch 44.

The magnetically actuatable anti-tamper switch 46 includes leads 58 and 60 respectively coupled with switch elements 52 and 54. The leads 58, 60 extend through the interior of housing 20 then pass through conduit 62, and form a part of an alarm circuit designed to initiate an alarm when the ball 56 is moved from one to the other of its switch positions as described below.

The section 16 also includes a separate movement sensor 64 (FIG. 4) located in laterally spaced relationship to anti-tamper switch 46 and adjacent the bottom wall 28 of housing 20. The sensor 64 is preferably a Magnasphere magnetically actuatable proximity switch of the type illustrated and described in FIG. 3 of pending application for U.S. Letters patent Ser. No. 12/172,788 filed Jul. 14, 2008, entitled TAMPER-RESISTANT ALARM SWITCH ASSEMBLY; this application is fully incorporated by reference herein. The sensor or switch 64 is very similar to anti-tamper switch 46 and includes a conductive housing 66 with a dielectric plug 68 and first and second switch elements 70 and 72. An electrically conductive, magnetically responsive, shiftable metallic ball 74 is within housing 66 and is moveable between respective switch positions where ball 74 is in simultaneous contact with the switch elements 70, 72, and out of such simultaneous contact. However, in lieu of a biasing ring, the sensor or switch 64 has an associated magnet 76 located adjacent the upper surface of housing 66. The magnet 76 is of sufficient strength to move ball 74 to its position out of simultaneous contact with switch elements 70, 72, in the absence of a stronger ambient magnetic field. The sensor or switch 64 also has leads 78 and 80 respectively connected with the switch elements 70, 72 and passing through housing 20 into conduit 62. The leads 78, 80 form a part of an alarm circuit.

The magnetic section 18 includes a housing 82 with upper and lower walls 84, 86, inner and outer walls 88, 90 and end walls 92, 94, and has an internal synthetic fill 96. The housing 82 is secured to surface 19 of door 12 by means of four long screws 98 extending through the outer wall 90, fill 96, inner wall 88, surface 19 and into the interior of door 12. Internally, the section 18 also includes a large magnet 100 located, when door 12 is closed, directly beneath the sensor or switch 64. In this position, the magnet 100 is of sufficient strength to overcome the bias of magnet 76, thus moving ball 74 to the switch position where the ball 74 is in simultaneous contact with housing 66 (and thus switch element 72) and central switch element 70.

In the event that door 12 is opened while the alarm assembly 10 is armed, movement of the magnet 100 away from sensor or switch 64 causes the ball 74 to move under the influence of magnet 76, to thus change the switch condition of sensor or switch 64. This generates an alarm signal indicating the unauthorized door opening. However, an intruder may seek to defeat alarm assembly 10 by removing the alarm section 16 from doorframe 14 by removing the screws 30 and 36. While the screws 30 can be easily removed, detachment of the screw 36 requires that plug 38 be removed from passageway 32 and access-blocking magnet 42 pulled from its original position, thereby allowing access to screw 36. However, the movement of magnet 42 from its initial anti-tamper position adjacent the head of screw 36 causes actuation of the anti-tamper switch 46. Specifically, in the original anti-tamper position of magnet 42, the latter serves to overcome the bias of ring 57, moving the ball 56 to the FIG. 6 position in simultaneous contact with switch elements 52 and 54. However, upon removal of magnet 42, the magnetic field of biasing ring 57 moves the ball 56 to the FIG. 7 position thereof. This generates an alarm signal indicating the attempted tampering with alarm section 16.

It will be appreciated that the anti-tamper switch 46 be positioned at a variety of different orientations within section 16, with the illustrated position being merely exemplary. Moreover, the attractive components of switch 46 and the access-blocking element 42 may be reversed, i.e., the shiftable ball 56 may be formed of magnetic material while the element 42 is formed of a material which is magnetically attracted to the ball 56. Furthermore, while the switches 46 and 64 are depicted as within a single housing 20, it would be possible to provide separate, interconnected switch housings. If desired an anti-tamper switch could be provided for the section 18. That is, an appropriate anti-tamper switch 46 and access-blocking element can be provided within housing 66 adjacent one of the fastening screws serving to attach the housing 66 to door 14 or any other surface, which would generate an alarm signal in the event of attempted removal of section 18.

Finally, while the anti-tamper assembly 40 has been shown in the context of the alarm section 16, the invention is not so limited. Broadly, the assembly 40 may be used to sense the attempted removal of virtually any type of body attached to a surface by a fastener.

Figure 10:
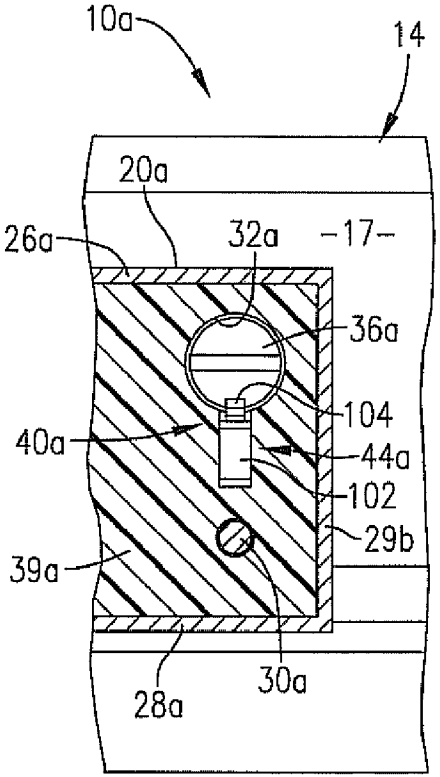
FIG. 10 is a fragmentary vertical sectional view depicting the orientation of the mechanical anti-tamper switch in the alarm condition thereof upon removal of the access-blocking element.
Figure 9:
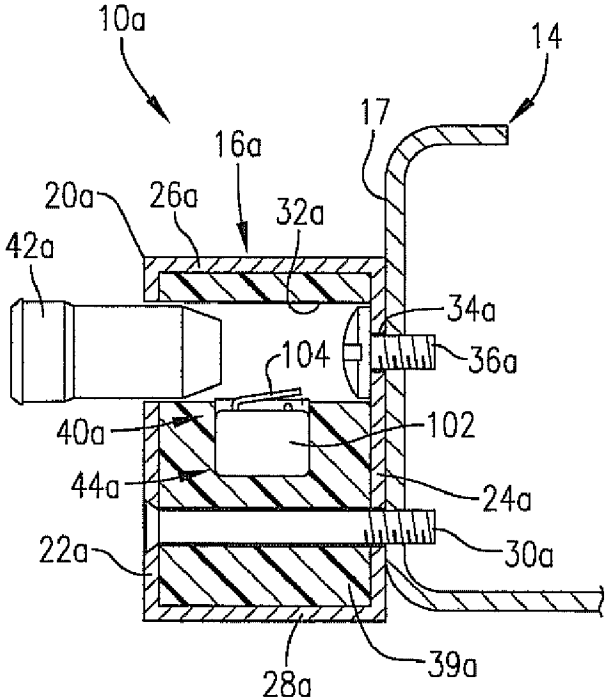
FIG. 9 is a view similar to that of FIG. 7, but illustrating the actuation of the anti-tamper switch upon removal of the access-blocking element.
Figure 8:
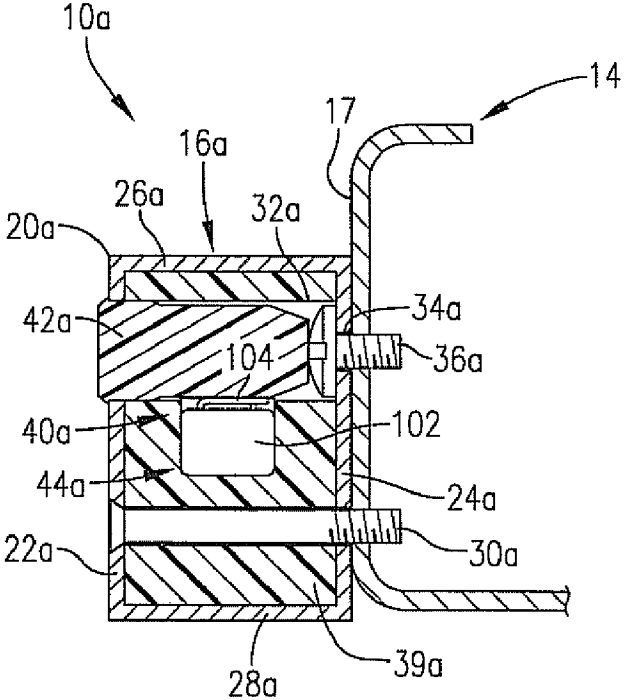
FIG. 8 is a vertical sectional view of another embodiment of the invention, using a mechanically actuated anti-tamper switch.

Embodiment of FIGS. 8-10 Using Mechanically Actuated Anti-Tamper Switch

The alarm assembly 10*a* can if desired make use of an alarm section 16*a* employing a mechanically actuated anti-tamper switch in lieu of the magnetically actuatable switch of the first embodiment. The assembly 10*a* has an alarm section 16*a* mounted on the exterior surface 17 of door frame 14, and a complemental magnetic section (not shown) identical with previously described section 18.

In more detail, the alarm section 16*a* includes a box-like housing 20*a* having an outer wall 22*a*, inner wall 24*a*, top and bottom walls 26*a*, 28*a*, and end walls 29*b*. The inner wall 24*a* abuts surface 17 as shown. A total of three long screws 30*a* extend through suitable openings provided in the walls 22*a*, 24*a* and through the outer surface 17 of doorframe 14 and into the interior of the latter. Additionally, the housing 20*a* has a larger passageway 32*a* extending through outer wall 22*a* and which is aligned with a smaller, screw-receiving opening 34*a* provided through inner wall 24*a*. A short screw 36*a* extends through the opening 34*a*, and passes through surface 17 and into the interior of doorframe 14. The interior of section 16*a* has a synthetic fill 39*a* which fills the entirety of the section save for the operative and connective components therein, and the passageway 32*a*.

The section 16*a* further includes an anti-tamper assembly 40*a* designed to initiate an alarm in the event that an intruder attempts to remove the alarm section 16*a* from doorframe 14 by removal of screws 30*a* and 36*a*. Generally, the assembly 40*a* comprises an anti-tamper access-blocking element 42*a* in the form of a plug-like cylindrical body positioned in proximity to the head of screw 36*a*, and a mechanically actuatable anti-tamper switch 102 operably coupled with the access-blocking element 42*a*. The switch 102 is preferably a conventional micro-switch having a shiftable, biased actuating arm 104. As illustrated in FIG. 8, when the access-blocking element 42*a* is properly positioned within passageway 32*a*, the arm 104 is depressed, causing the micro-switch 102 to assume a first switch condition. However, in the event that an intruder attempts to detach section 16*a* from doorframe 14 by removal of the screws 30*a* and 36*a*, pulling the element 42*a* from passageway 32*a* causes arm 104 to move (see FIGS. 9 and 10) so that the micro-switch 102 assumes a second switch condition Although not shown, it will be appreciated that the micro-switch 102 is connected to an alarm circuit including electrical leads such as the leads 58 and 60 of the first embodiment. Accordingly, movement of the switch arm 104 initiates an alarm indicating the attempted tampering.

Inasmuch as the switch 102 does not rely upon ambient magnetic conditions for actuation thereof, the access-blocking element 42*a* may be formed of any suitable material such as metal or synthetic resin.

I claim:

1. An anti-tamper alarm assembly configured to detect relative movement between first and second members each presenting surfaces, comprising:

an alarm section secured to the surface of said first member by a fastener extending through the first member surface, said alarm section including a sensor configured to detect said relative movement between said first and second members, an antitamper magnetic component in an anti-tamper position proximal to said fastener, and a magnetically actuatable anti-tamper switch operably coupled with said anti-tamper magnet, said anti-tamper magnetic component causing the anti-tamper switch to assume a first switch condition when the anti-tamper magnetic component is in said anti-tamper position, said anti-tamper switch configured to assume a second switch condition when said anti-tamper magnetic component is moved from said anti-tamper position to a tamper position permitting access to said fastener for removal thereof, said sensor comprising a proximity switch including a switch assembly having a first elongated switch element, a second switch element disposed in spaced relationship to the first switch element, and a body moveable between first and second switch conditions, one of said switch conditions being when the moveable body is in simultaneous contact with both switch elements, and the other of said switch conditions being when said moveable body is out of simultaneous contact with the switch elements; and an alarm circuit coupled with said anti-tamper switch and configured to generate an alarm signal in response to said movement of said anti-tamper magnetic component to said tamper position.

2. The assembly of claim 1, including a proximity magnet mounted on the surface of said second member, said proximity magnet configured to maintain said body of said proximity switch one of said switch conditions when the first and second members are adjacent, said body of said proximity switch configured to move to the other of said switch conditions when said second member is moved to said remote position relative to said first member.

3. The assembly of claim 2, there being a magnetic section associated with said proximity switch and configured to move said body of said proximity switch to the other of said switch conditions upon movement of the second member to said remote position relative to said first member.

4. The assembly of claim 1, said first member being a doorframe, and said second member comprising a door mounted in said doorframe.

5. The assembly of claim 1, said fastener comprising a screw extending through said body and through said surface of said first member, said anti-tamper magnetic component positioned adjacent the head of said screw.

6. The assembly of claim 1, said anti-tamper magnetic component being a magnet.

7. The assembly of claim 6, said anti-tamper switch including a shiftable body which is magnetically attracted to said anti-tamper magnet.

* * * * *